US005078113A

United States Patent [19]

Haag et al.

[11] Patent Number: 5,078,113

[45] Date of Patent: Jan. 7, 1992

[54] RESERVOIR-TYPE FUEL INJECTION SYSTEM

[75] Inventors: Gottlob Haag, Markgroeningen; Helmut Rembold, Stuttgart; Walter Teegen, Waiblingen-Hohenacker, all of Fed. Rep. of Germany

[73] Assignee: Robert Bosch GmbH, Stuttgart, Fed. Rep. of Germany

[21] Appl. No.: 444,247

[22] Filed: Dec. 1, 1989

[30] Foreign Application Priority Data

Feb. 4, 1989 [DE] Fed. Rep. of Germany ..... 3903313

[51] Int. Cl.[5] ..... F02M 7/00

[52] U.S. Cl. ..... 123/447; 123/450; 417/462

[58] Field of Search ..... 123/447, 450, 462, 460, 123/458; 417/462

[56] References Cited

U.S. PATENT DOCUMENTS 4,401,082 8/1983 LeBlanc ..... 123/450
4,572,136 2/1986 Takeuchi ..... 123/447
4,574,759 3/1986 LeBlanc ..... 123/450
4,601,274 7/1986 Seilly ..... 123/450
4,879,984 11/1989 Rembold ..... 123/450
4,920,940 5/1990 Harris ..... 123/447

*Primary Examiner*—Carl S. Miller
*Attorney, Agent, or Firm*—Edwin E. Greigg; Ronald E. Greigg

[57] ABSTRACT

A reservoir fuel injection system, in which fuel is deliverable under pressure to a reservoir having a line carrying fuel under pressure from the reservoir via a valve assembly to at least one injection nozzle and having an adjustable throttle for varying the quantity of fuel supplied to the reservoir, is embodied such that the throttle upon attainment of the maximum pressure in the reservoir and/or the maximum reservoir volume, enables the aspiration of a minimum quantity of fuel in an intake line of the charge pump and/or connects the pressure line at least partly with the intake line; and/or the pressure reservoir, upon attainment of the maximum pressure in the reservoir and/or the maximum reservoir volume, opens an outflow cross section.

21 Claims, 6 Drawing Sheets

RESERVOIR-TYPE FUEL INJECTION SYSTEM

BACKGROUND OF THE INVENTION

The invention relates to a reservoir-type fuel injection system, in which fuel can be delivered under pressure to a reservoir, having a line carrying pressure fuel under pressure from the reservoir via a valve assembly to at least one injection nozzle, and having an adjustable throttle to vary the quantity of fuel supplied to the reservoir.

In reservoir fuel injection systems of the types described above, a pressure reservoir is supplied with fuel under pressure from a continuously pumping charge pump; a check valve is provided between the charge pump and the pressure reservoir to prevent fuel from being forced back into the pump under pressure in the intake stroke of the pump. Reservoir fuel injection systems consequently require control devices, which monitor the quantity and timing of the further delivery of the fuel under pressure to the injection nozzle; rotating distributor shafts and/or valve assemblies, in particular magnetic valves, are used for this purpose. In typical reservoir fuel injection systems of the type described at the outset above, there is no particular regulation of the charge pump; provision is merely made so that the charge pump will pump a sufficient quantity of fuel into the reservoir, which prevents the ability to completely evacuate the reservoir, particularly at high rpm.

In such reservoir fuel injection systems, particularly in engine overrunning, a substantially higher pump feed quantity encounters a withdrawal of fuel from the reservoir that may extend to zero. Adapting the feed quantity of the pump to the requirement, with certain limitations, has already been proposed in U.S. Pat. No. 4,572,136. In this known system a pressure reservoir was used, the reservoir piston of which has a circumferential groove that upon displacement of the reservoir piston represents a variably great, throttle resistance in the intake line of the charge pump. However, in this known system, the governing functions only as long as the withdrawal from the reservoir does not proceed definitively to zero, as is the case for instance in engine overrunning, because in these cases the intake line is overtaken entirely and blocked by the known piston embodiment. As a consequence, the pump can run dry, because no further fuel is supplied to it via the intake line, and the intake line is completely closed. In any event, such an embodiment leads to increased pump wear and to a shortening of its service life; particularly with feed quantities tending to zero, the consequence may be destruction of the pump, and particularly of the tightness properties of the pump.

OBJECT AND SUMMARY OF THE INVENTION

An object of the invention is to devise a reservoir-type fuel injection system of the type defined at the outset above, in which the danger of overload and of excessive wear of the pump is reliably avoided even when the quantity consumed tends toward zero, and which thus assures an unchanged long service life of the charge pump, even in a pump overrunning operation. To attain this object, the invention substantially comprises providing that the throttle, upon attainment of the maximum pressure in the reservoir and/or the maximum reservoir volume, enables the aspiration of a minimum quantity of fuel in an intake line of the charge pump and/or connects the pressure line at least partly with the intake line; and/or the pressure reservoir, upon attainment of the maximum pressure in the reservoir and/or the maximum reservoir volume, opens an outflow cross section. Because pumping of a minimum quantity of fuel by the charge pump is assured, the pump is reliably prevented from running hot, particularly in overrunning, and the required minimum quantity for preventing such hot running of the pump can be attained by alternative routes of substantially equal value, which may optionally be used simultaneously. A first such possibility is to dimension the throttle in the intake line such that it can never completely close the intake line. A further possibility, however, is upon attaining the maximum reservoir volume or the intended maximum pressure in the reservoir, a bypass line is opened, which at least partly connects the pressure line to the intake line, and as a result the feed quantity remains substantially unchanged. Pumping then is effected via the throttle back to the intake line, so that no further pumping into the reservoir itself occurs. Finally, provision can be made in the pressure reservoir itself so that a minimum of pump feed quantity is maintained even when the reservoir is maximally full, to which end the pressure, reservoir can be made to communicate via a control edge with an outflow cross section. This last possibility of uncovering an outflow cross section in a throttled manner in the reservoir itself when the maximum reservoir volume or the maximum allowable reservoir pressure is attained, can naturally be suitably used only if the reservoir spring is designed such that fluttering of the reservoir piston and the attendant undesirable buildup of pressure waves in the reservoir do not occur. Therefore, provisions in which it is simultaneously possible to even out the reservoir pressure and keep it constant are preferred, and so that reservoir fuel injection system according to the invention is especially advantageously embodied such that the throttle is embodied by a piston displacable counter to the force of a spring and penetrating the line cross section to be throttled, wherein the piston has a transverse bore or circumferential groove plunging into the line cross section to be throttled, and is acted upon counter to the force of the spring by the pressure of the reservoir or of the pressure line. In addition, in such an embodiment it is naturally always possible, for overload protection, to uncover an outflow cross section in the reservoir itself upon attaining the maximum fill level. Because a separate piston, displaceable counter to the force of a spring, is now provided, this provides the prerequisite so that a sliding regulation, which is particularly gentle to the pump, of the pressure conditions or feed conditions of the pump becomes possible. A control slide of this kind, embodied by a piston penetrating the line cross section, used as a throttle can be disposed particularly simply in a branch line connecting the intake line to the pressure line; this offers the further advantage of accommodating such a throttle in a space-saving manner. While in the embodiment of U.S. Pat. No. 4,572,136 the control slide had to be embodied as a common component coaxially with the piston of the reservoir, a control slide of the kind of the invention, incorporated into a branch line, can be accommodated at any arbitrary point, thus resulting in a compact structure and a system that can be regulated precisely.

The separation of the control slide, or piston penetrating the line cross section to be throttled, from the piston of the pressure reservoir further makes it possible, as described for a preferred embodiment of the invention, to use springs having advantageous spring characteristic curves for the throttle. The embodiment is advantageously such that the spring acting upon the piston of the throttle has a degressive spring characteristic curve. This kind of degressive or negative spring characteristic curve makes it possible to prevent fluttering of the slide valve and offers the opportunity, while avoiding pronounced pressure waves upon attainment of the maximum reservoir volume or maximum reservoir pressure, to continue operating the pump while protecting it as much as possible, without varying the pumping output of the pump. Embodying the slide valve separately has the further advantage of providing additional pressure-controlled provisions that result in secure opening and closing and a precise adjustment of throttle cross sections, with compact throttles. A particularly preferred possibility here is to provide that the reservoir has at least one control bore or annular groove that can be overtaken by the reservoir piston, by way of which groove, upon attainment of the intended fill volume of the reservoir, pressure fluid is carried to an end face, remote from the spring, of the piston of the throttle. In such an embodiment, the pressure built up in the reservoir is carried without any abrupt pressure wave, upon the overtaking of a control bore in the pressure reservoir, to the face end of the piston embodying the throttle located opposite the spring of this piston; as a result, rapid and correct adjustment of the throttle cross section can be accomplished, for example in a bypass line around the intake line. To enable dimensioning a suitably small spring of such a throttle, the spring action can also be reinforced with pressure, for example, the pre-pump pressure in the intake line; in that case, to assure the deflection stroke of the throttling piston, the embodiment is advantageously such that in that the relief bore of the reservoir piston, upon opening of a first control bore by way of which pressure fluid is carried from the reservoir to the throttle piston, is flush with a second control bore, which communicates via a line with the spring chamber of the piston of the throttle, and that the intake line is connected to the spring chamber via an outwardly closing check valve, and the pressure reduction can be accomplished in a simple manner by providing that the spring-loaded reservoir piston have a relief bore overtaking the control bore or bores. In this way when the end face of the piston of the throttle facing the spring is acted upon, fuel present in the spring chamber to reinforce the spring force is expelled at pre-pump pressure via the relief bore, so that the displacement motion in these cases is unhindered. The overall result of such provisions is an extensive hydraulic damping of the motion of a throttle valve, by which means undesirable pressure waves can be reliably avoided.

In such an embodiment, the uncovering of an outflow cross section upon attaining the maximum reservoir pressure can be additionally or alternatively assured in a simple manner by providing that the reservoir chamber can be relieved via an overpressure valve, integrated with the reservoir piston, into the spring chamber of the reservoir piston and/or via a second control bore into the spring chamber of the piston of the throttle.

A particularly simple structural provision for maintaining a minimum cross section in the intake line is that the piston of the throttle is displaceable counter to the force of the spring between stops, in particular stop sleeves. In such an embodiment, the reservoir itself ma be embodied with a spring and may for instance be embodied as a compression reservoir, with the required reservoir pressure being maintainable by means of a relatively small-sized, weak spring of the deflection piston embodied as a throttle. Because of its relatively small end face cross section, the piston of the throttle can reliably compensate for a correspondingly high pressure in the compression reservoir even with a slight spring load.

Throttling in a bypass line between the pressure line and the intake line can in principle lead to an undesirable forcing of fuel under pressure out of the reservoir back into the intake line. If while protecting the pump a much as possible a rapid switchover to pumping back into the flow line is desired upon attaining the maximum fill volume in the reservoir or the maximum reservoir pressure, the embodiment can be particularly advantageously such that when the throttle is incorporated into a branch line connecting the pressure line to the intake line, the pressure reservoir communicates, via a check valve closing toward the pump, with the pressure line downstream of the connection point of the branch line.

The throttling of the fuel delivery to the intake line of the pump, while extensively protecting the pump, can also be attained, in accordance with a preferred embodiment, in that the throttle is embodied as a control bushing surrounding the pump piston, the control edge of which bushing, communicating with the intake line, is displaceable axially with the control bushing in order to limit the effective pump stroke, and that the control bushing is connected to the movable part of the pressure reservoir. In a particularly simple manner, the embodiment is then such that the control bushing, with a bottom and a stopper sliding in stationary fashion in it, defines the reservoir chamber of the pressure reservoir and is acted upon by a restoring spring. With this kind of axially displaceable control bushing, the effective pump stroke ca be adjusted; the axial adjustment of such a control bushing can in principle be effected hydraulically, for example, using the pressure in the pressure reservoir. Alternatively, the axial adjustment of such a control bushing can also be performed such that the control bushing of the pump is mechanically coupled to the stroke of the piston of the pressure reservoir. To limit the maximal reservoir volume, the embodiment is advantageously such that with the control bushing, a valve controlled as a function of the stroke of the control bushing and relieving the reservoir chamber, is controlled.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
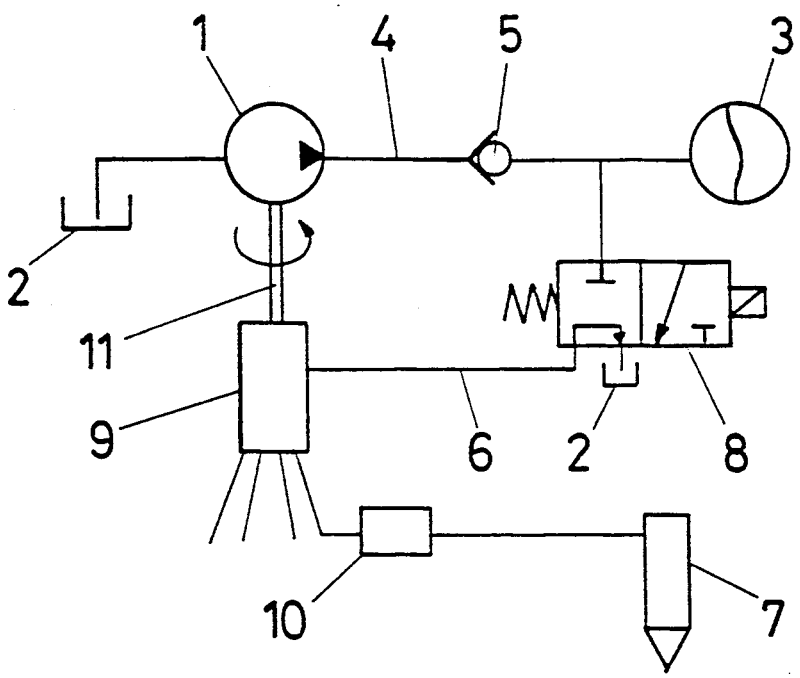
FIG. 1 is a schematic view of the basic layout of an injection system according to the invention.

In the schematic view of FIG. 1, a charge pump 1 is shown, which delivers fuel from a tank 2 to a reservoir 3 under pressure; a one-way check valve 5 that prevents the fuel, which is at high pressure, from flowing back out of the reservoir 3 in the intake stroke of the pump 1 is provided in the supply line 4. From the reservoir 3 or pressure line 4, the fuel flows via a magnetic valve 8, incorporated into a supply line 6 and via a distributor shaft 9 and a pressure valve 10 to the injection nozzle 7. The magnetic valve 8 is embodied as a 3/2-way magnetic valve, and via this magnetic valve 8, both the instant and quantity of injection can be controlled in a simple manner via the ON time of the magnetic valve. The pump itself, in a manner not shown in further detail, rotates at the rpm of the camshaft and is coupled to the distributor shaft 9, as indicated at 11. Depending on the rotational position of the distributor shaft 9, a particular injection nozzle 7, associated with a cylinder, is subjected to fuel under pressure. By means of the coupling, the adaptation of the feed quantity of the pump to the injection quantity is dependent on rpm; the load-dependent adaptation is accomplished via a governing device described hereinafter.

Figure 2:
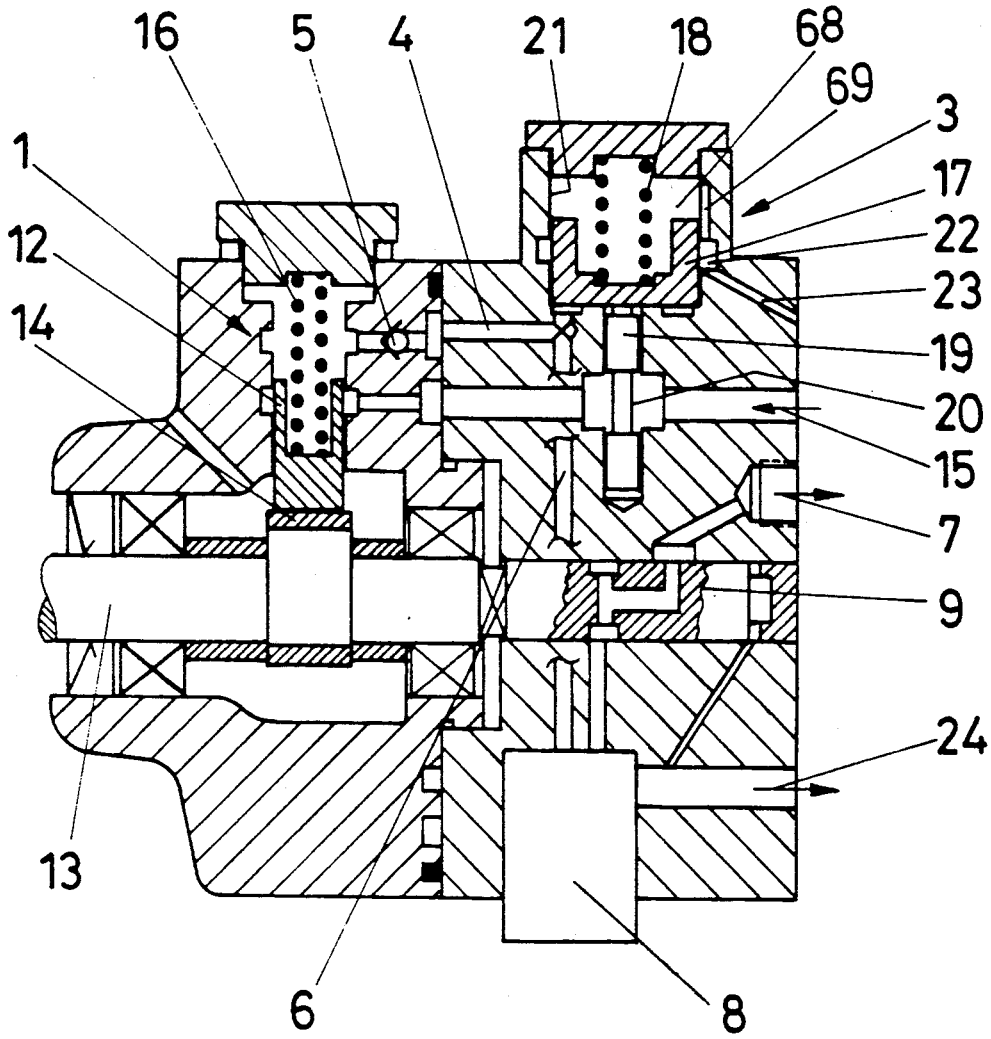
FIG. 2 is a section through a first embodiment of the reservoir fuel injection system according to the invention.

FIG. 2 shows a piston 12 of the fuel pump 1, which is embodied as a radial piston pump. The pump may have a total of three pistons, for example. The piston is moved, via an eccentric cam 14 provided on a driveshaft 13 inside a chamber filled with lubricating oil, as a function of the rpm of the shaft; the aspiration of fuel takes place via an inflow line 15 from a tank, not shown in further detail, and the pressure line to the reservoir 3 is again identified by reference numeral 4. To prevent the return flow of fuel during the intake stroke of the piston 12 which acted upon by a spring 16 is kept in constant contact with the eccentric cam 14, the check valve 5 in the pressure line 4 is again used. From the reservoir 3 or pressure line 4, the pumping of fuel at high pressure takes place again via the line 6, in which the magnetic valve 8 and the distributor shaft 9, coupled to the driveshaft 13, are incorporated, to a nozzle not shown in further detail, as indicated by the arrow 7.

The reservoir 3 has a reservoir piston 17, which in the exemplary embodiment of FIG. 2 is loaded by a spring 18, by means of which the operating pressure of approximately 200 bar is adjusted. A slide valve 19 is directly connected to the reservoir piston 17; the slide valve 19 has an offset region 20 and represents a throttle cross section in the inflow or intake line to the pump 1 as a function of the fill level and hence the stroke of the reservoir piston 17. The offset region 20 is dimensioned such that even at a maximum fill level of the reservoir 3, a minimum cross section of the inflow line 15 to the pump 1 is opened up, to prevent the pump from running dry at a maximum fill level of the reservoir 3. Further protection of the pump against running hot during overrunning, or in other words when the injection quantity tends towards zero, is attained not only by the throttling of the delivery to a minimum quantity, but also by providing that upon attainment of the maximum reservoir volume, the reservoir piston 17 opens up an outflow cross section 22, embodied as an annular groove in the guide bore 21 of the reservoir piston 17. Discharging into this annular groove are a return line 23 and a longitudinal groove 69 in the guide bore 21, the longitudinal groove communicating with a spring chamber 68 defined at the rear by the reservoir piston 17 and receiving the spring 18. This assures that the minimum quantity pumped by the pump is pumped out by the pump, even at an injection quantity of zero, by the leaving open of a minimum throttle cross section in the inflow line. The reservoir spring, 18 has a low spring constant, so that any variations in reservoir pressure in the governing range are negligible.

FIG. 2 also shows a return line 24 connected to the magnetic valve 8.

Figure 3:
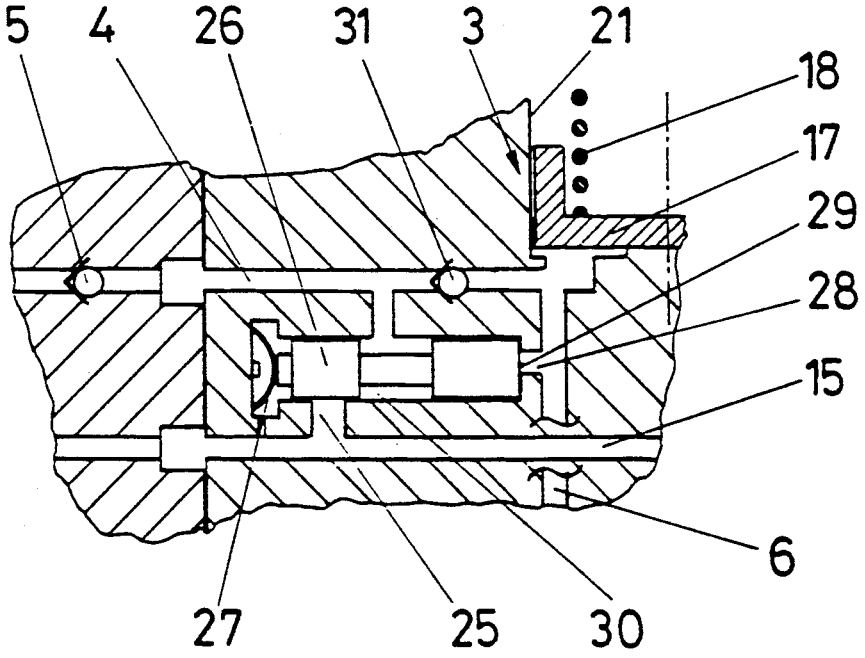
FIG. 3 is a fragmentary section, similar to FIG. 1, through a modified embodiment, showing only the intake and pressure lines of the charge pump and a throttle incorporated into a branch line.

In the zone of a modified embodiment shown in FIG. 3, the reference numerals of FIGS. 1 and 2 have been maintained for identical components. In this embodiment, a throttle 26 in the form of a piston slide and acted upon by a spring 27 is incorporated into a branch line 25 between the intake line 15 and the pressure line 4. A branch line 28 is connected to the line 6 leading out of the reservoir 3 to the magnetic valve or to the injection nozzle, and by way of this branch line, if the operating pressure in the reservoir 3 is exceeded, the end face 29 remote from the spring 27 of the piston slide is acted upon by fuel at reservoir pressure, whereupon, after a displacement of the throttle 26 counter to the force of the spring 27, the bypass line 25 between the inflow 5 and the high-pressure line 4 is opened via a circumferential groove 30 provided on the circumference of the throttle. The result directly is pumping out of the pressure line 4 at least partly into the inflow 15, in order to prevent a further increase in the pressure in the reservoir or to prevent exceeding the maximum fill quantity of the reservoir. To prevent evacuation of the reservoir 3 into the inflow line 15 when the branch line 25 is opened, a further check valve 31, opening toward the reservoir 3, is provided in the pressure line 4 in the pumping direction, downstream of the connection point of the branch line 25 to the pressure line 4. To prevent any disadvantageous results at the switching valve or throttle 26, the plate spring 27 has a negative characteristic curve, or in other words a decreasing force when compressed. To maintain the operating pressure, a precise matching of the spring 18 of the pressure reservoir and the spring 27 of the throttle 26 is necessary.

Figure 4:
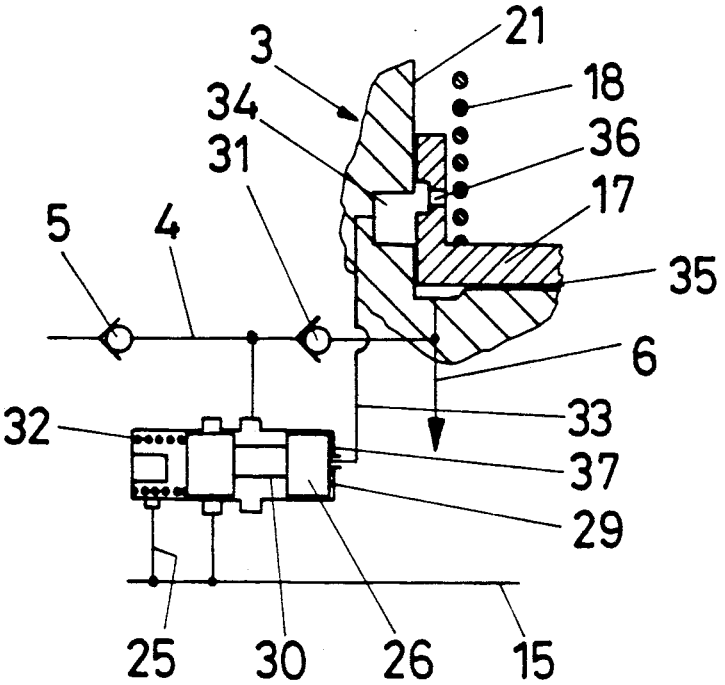
FIG. 4 is a schematic view of a further embodiment, showing only the zone shown in FIG. 3.

This kind of accurate matching of the spring forces of the pressure reservoir 3 and throttle 26 in the branch line between the high-pressure line and the intake line or supply line 15 is not so critical in an embodiment as shown in FIG. 4. In this embodiment, once again, the throttle 26 embodied as a piston slide in the branch line 25 between the high-pressure line and the inflow line 15 is embodied with a circumferential groove 30; when the end face 29 of the piston slide remote from a spring 32 is acted upon, once again the branch line 25 is opened up. Unlike the embodiment of FIG. 3, the line 33 subjecting the end face 29 opposite the spring 32 with fuel at reservoir pressure communicates in this embodiment with a control groove 34 embodied as an annular groove and provided in the guide bore 21 of the reservoir piston 17; action is not exerted upon the piston 26 until the end face 35, embodied as a control edge, of the reservoir piston 17 overtakes the control groove 34, as shown in further detail in FIG. 5*c*. For relief of the throttle 26, the reservoir piston 17 has a relief bore 36 in its wall, leading to the spring chamber 68, and at a fuel volume that is below the maximum fuel volume of the reservoir 3 this relief bore communicates with the control groove 34.

Figure 5A:
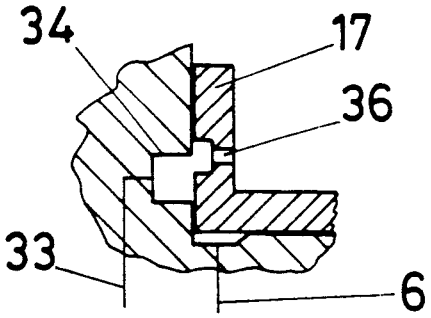
FIGS. 5*a*, 5*b* and 5*c* show various positions of the reservoir piston of FIG. 4.
Figure 5B:
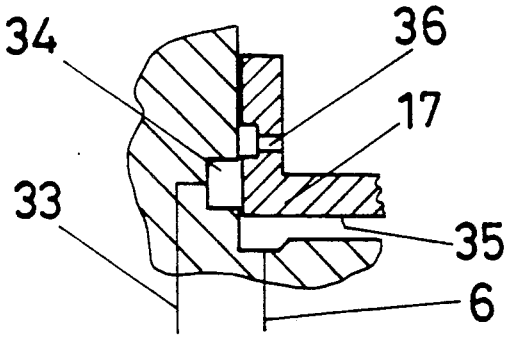
Figure 5C:
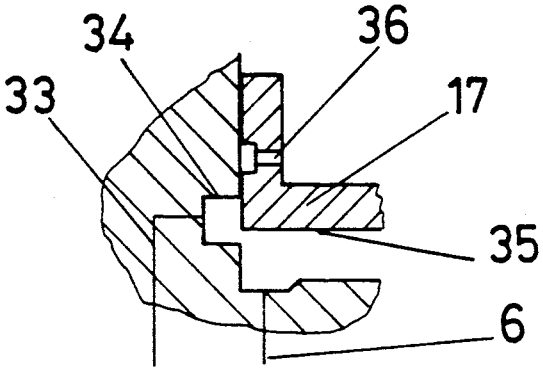

The various positions of the reservoir piston 17 relative to the control groove 34 are shown in further detail in FIGS. 5*a*–5*c*. When the control groove 34 is overtaken by the end face 35 of the piston 17, as shown in FIG. 5*c*, the piston slide 26 is acted upon by fuel at reservoir pressure and displaced counter to the force of the spring 32, causing the branch line 25 between the high-pressure line 4 and the return line to be opened and interrupting a further delivery of fuel to reservoir 3. The relief of the throttle 26 takes place in the position shown in FIG. 5*a*, in which the control groove 34 communicates with the relief bore 36 of the reservoir piston 1, so that the fuel acting upon the end face 29 of the throttle can be drawn from the corresponding piston chamber 37, and the piston slide 26, by action via the spring 32, again closes the connection 25 between the high-pressure line 4 and the inflow line 15. In FIG. 5*b*, an intermediate position of the reservoir piston 17 is shown, in which the control groove 34 is closed by the piston 17. To assure that in this position, the leakage via the piston guide wall not cause a switchover of the throttle 26, the spring 32 must be suitably strongly prestressed. The desired switching hysteresis can be established by the of the association and dimensioning of the control edges embodied by the control groove 34, the relief bore 36 and the end face 35 of the reservoir piston.

Figure 6:
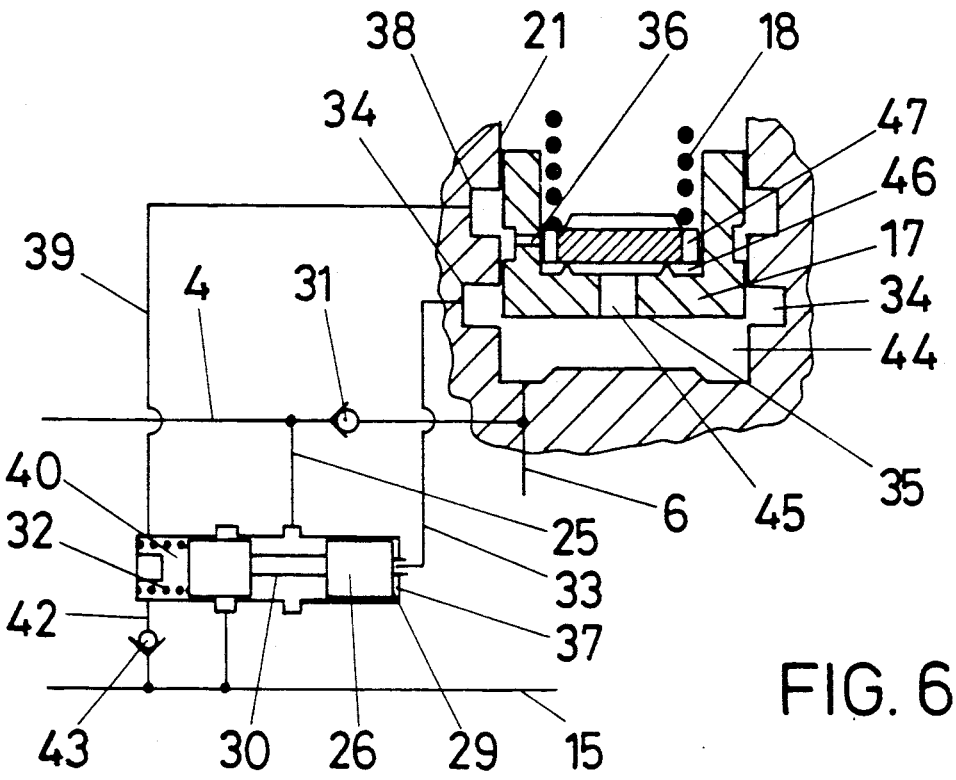
FIG. 6 shows a further modified embodiment, in a view similar to FIG. 4.

A modified embodiment compared with FIG. 4 can be found in FIG. 6, in which the throttle 26 is again incorporated into the branch line 25 between the pressure line 4 and the inflow line 15; when the throttle 26 is acted upon by fuel at reservoir pressure, it is displaced counter to the force of the spring 32 and via the circumferential groove 30 again opens the connection 25. The action upon the end face 29 remote from the spring of the throttle 26 again takes place by the uncovering of a first control groove 34 by the end face 35 of the reservoir piston 17. Once again the reservoir piston 17 has a relief bore 36, which in the position of the reservoir piston 17 shown in FIG. 6, in which the action upon the throttle 26 is initiated, communicates with a second control groove 38 in the guide bore 21, by way of which groove, via a line 39, a spring chamber 40 receiving the spring 32 of the throttle 26 is relieved; this spring chamber 40 communicates with the inflow line 15 via a line 42 containing a one-way check valve 43 that opens toward the spring chamber 40. Closing of the throttle 26 takes place similarly to the embodiment of FIG. 4, in the position shown in FIG. 5*a*, in which the line 33 and the piston chamber 37 are relieved via the control groove 34 and the relief bore 36. In that case, the entry of fuel simultaneously takes place from the supply line 15 via a line 42 and a check valve 43 closing toward the supply line 15 into the spring chamber 40 of the throttle spring 32. In that position, the control groove 38 is closed by the reservoir piston. In this embodiment a weak spring 32 can be used, because the displacement of the throttle 26 is switched hydraulically via the control edges [previously called grooves] 34 and 38 by means of the filling of the spring chamber 40 with fuel from the supply line 15. In the embodiment shown in FIG. 6, an overpressure valve is also integrated with the reservoir piston 17, and fuel from the reservoir chamber 44 is carried via a bore 45 provided in the end face 35 into a chamber 46, which is defined by a piston 47, acted upon by the piston spring 18 and cooperating with an annular valve seat 73, which surrounds the bore 45 on the inward bottom of the reservoir piston 17. For communication with the pressure-relieved spring chamber 68, receiving the spring 18, of the pressure reservoir, the piston 47 has longitudinal recesses 74. By suitable dimensioning of the piston cross-sectional area, the piston 47 enables communication of the reservoir chamber 44 with the spring chamber 68 in the event of overpressure. The relief bores 36 are kept open by the longitudinal recesses 74.

Figure 8:
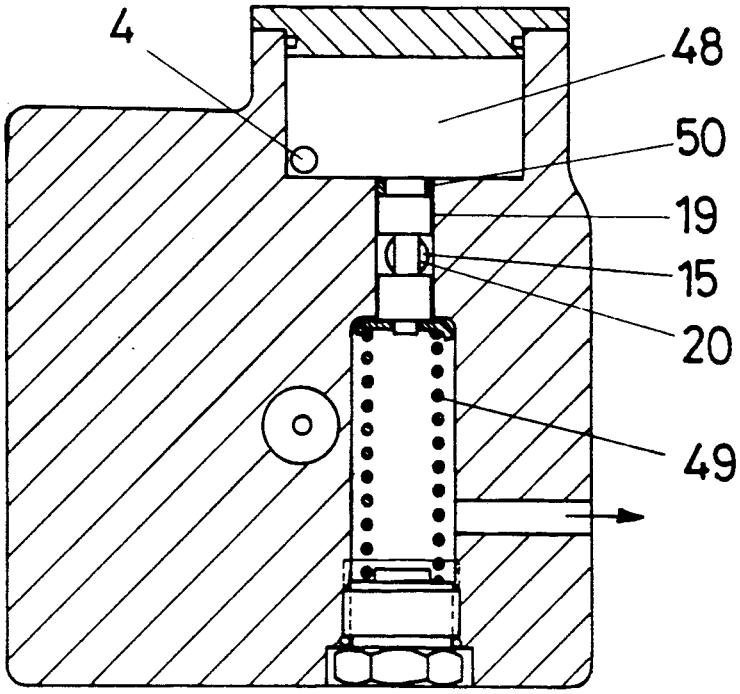
FIG. 8 is a section, on a larger scale, taken along the line VIII—VIII of FIG. 7 through a zone of the embodiment of FIG. 7.
Figure 7:
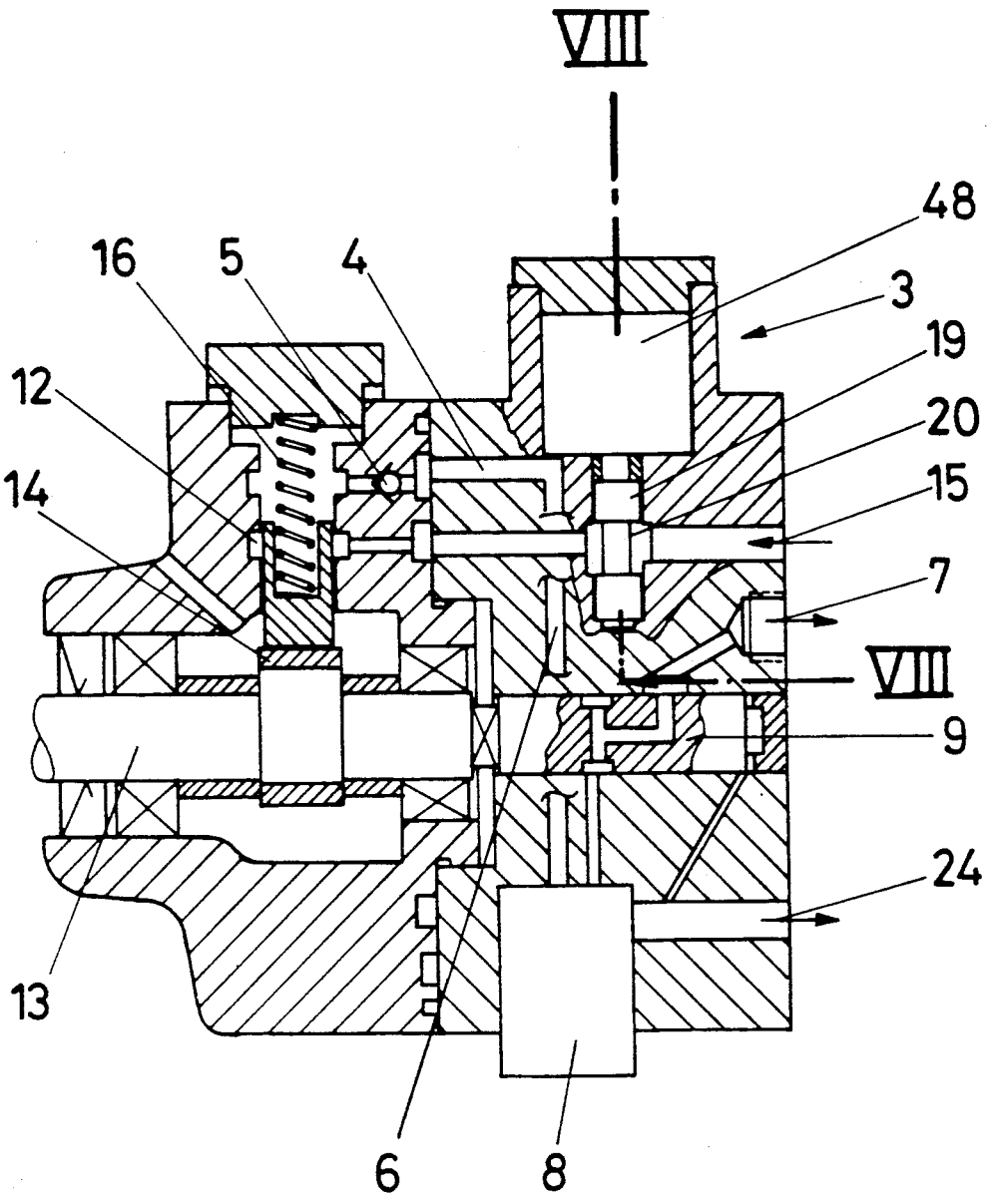
FIG. 7 is a section taken through a further variant embodiment in a view similar to FIG. 2, having a compression reservoir.

In FIG. 7, an embodiment modified from that of FIG. 2 is shown, in which the throttle 19 with the offset circumferential region 20 is again disposed directly in the inflow line 15. Instead of the spring-actuated pressure reservoir of FIG. 2, a compression reservoir 48 is used, and the throttle 19 embodied as a piston slide is acted upon by a spring 49, as shown in greater detail in FIG. 8. The offset region 20 of the throttle is once again embodied such that a minimum cross section of the inflow line 15 remains open in every case. The displacement motion of the throttle slide acted upon by the spring 49 is limited by a stop 50, on the side of which the face end of the piston slide 19 is exposed to the pressure of the compression reservoir 48. With this embodiment of a compression reservoir and with action upon the throttle 19 in the inflow line 15 by a spring, or in other words in the use of the throttle 19 as an additional reservoir piston, it becomes possible to prevent an excessive drop in the reservoir pressure from inertia of the reservoir piston at the onset of injection, which particularly at high rpm would result in excessively long injection times, or poor preparation of the fuel mixture. By dimensioning the cross-sectional area of the throttle 19 accordingly, high pressures can be absorbed even with a relatively weak spring, and the possibility is additionally afforded of accommodating the reservoir spring 49 in a space-saving manner in the housing of the reservoir fuel injection system.

Figure 9:
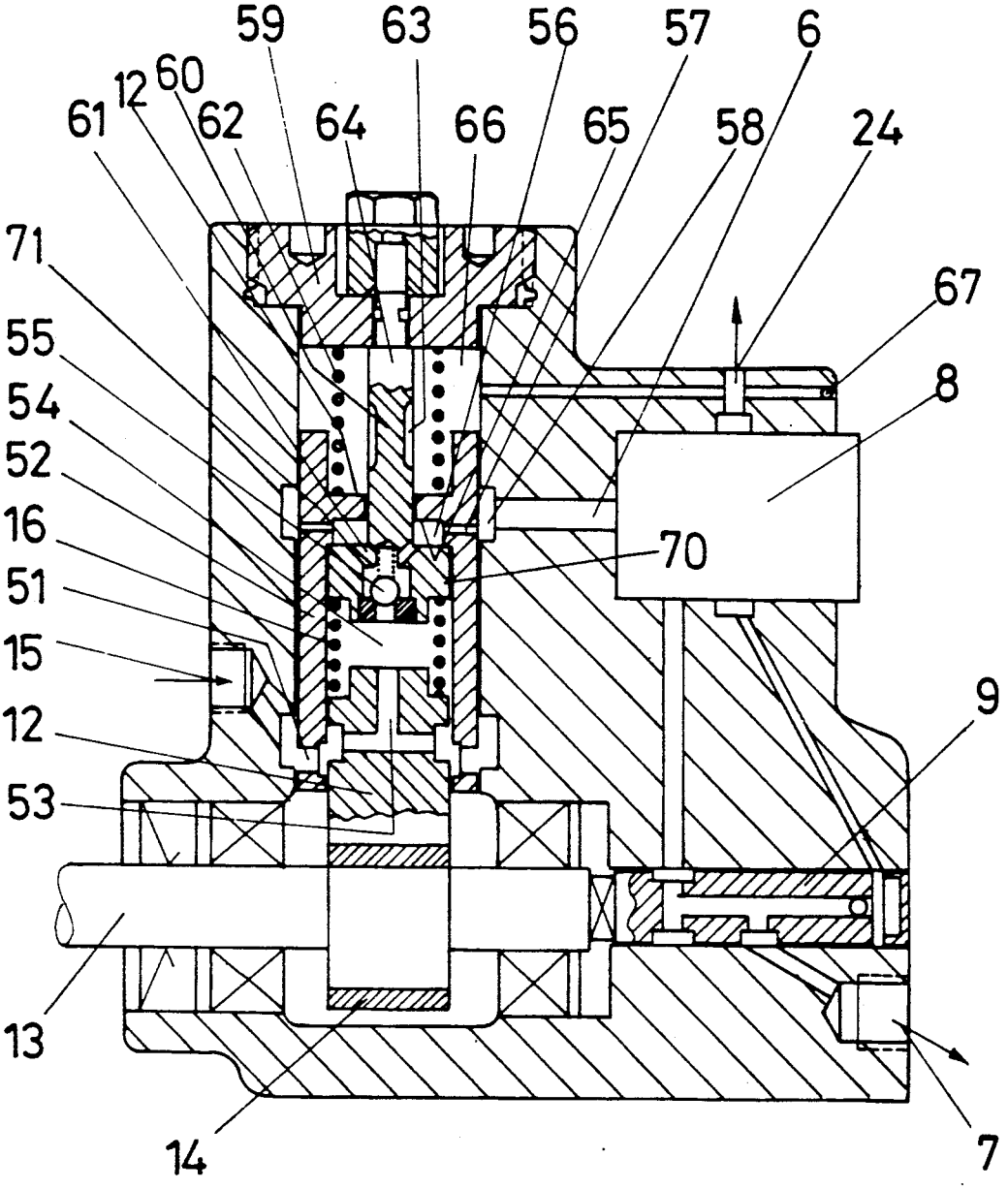
FIG. 9, in a view similar to FIG. 2, showing a reservoir fuel injection system according to the invention, in which the throttle is embodied as a control bushing surrounding the pump piston.

In the embodiment shown in FIG. 9, the piston 12 of the pump is again moved via an eccentric cam 14 of a driveshaft 13 and kept in contact with the cam 14 via the spring 16. The delivery of fuel from the inflow line 15 is effected in this embodiment by a radial inflow 51 in the wall of a control bushing 52 surrounding the pump piston 12 and via conduits or bores 53, embodied in the interior of the pump piston 12, into the pump work chamber 54 enclosed in the interior of the control bushing, which pump chamber simultaneously receives the pump piston spring 16, which is supported on a tightly guided, stationary stopper 70 that closes the end face of the control bushing 52 and defines the other side of the pump work chamber 54. Upon a reciprocating motion of the pump piston 12, after the closure of the communication via the inflow 51 and control bores 53 by the pump piston 12, fuel is introduced under pressure from the pump work chamber 54, via a check valve 55 disposed in the stopper 70, into a reservoir chamber 56, defined between the face end 71 remote from the pump work chamber 54 of the stopper 70 and a bottom 72 of the control bushing 52 closing it on the face end; via openings 57, this reservoir chamber 56 discharges into a groove 58 discharging along with the pressure line into the magnetic valve 8. The stopper 70 is provided with a piston portion 60 axially penetrating the bottom 72 and having a diameter smaller than that of the stopper 70; this piston portion is supported on a closure element 59. A spring 62, which is equivalent to the spring 18 of FIG. 2 and is the restoring spring for the control bushing 52, simultaneously serving as the reservoir piston and having the reservoir chamber 56, is fastened between the closure element 59 and the bottom 72. The supply lines into the reservoir chamber 56 are identified by reference numeral 61. The control bushing 52 is displaceable counter to the force of the spring 62 when the volume of the fuel introduced into the reservoir chamber 56 rises, and by this kind of motion of the control bushing 52 a reciprocating motion of the control edge 51 cooperating with the fuel inflow line 15 is effected, so that with increasing volume in the reservoir chamber 56, overtaking of the control bore 51 by the control conduits 53 of the pump piston 12 does not occur until a later moment, as a result of which the effective supply stroke of the pump piston 12 is shortened, and at the same time a reduction in the supply quantity results. In this function, the control bushing 52 serves as a throttle in the form of a control slide. The disposition of the control bores 51 of the control bushing 52 acting as a throttle and of the control bores 53 of the pump piston is selected such that in each case a minimum quantity of fuel is supplied to the work chamber 54. A limitation of the maximum reservoir volume is attained by means of a circumferential groove 63 or longitudinal grooves on the piston 60, and upon overtaking of the bottom 72, defining the reservoir chamber 56, of the control bushing 52 a diversion of fuel out of the reservoir chamber 56 takes place via the circumferential groove 63 into the spring chamber 66 receiving the spring 62 and into a return line 67 adjoining the spring chamber 66.

It is a condition for satisfactory function of the embodiment shown in FIG. 9 that the pressure defined and prescribed by the spring 62 always prevail in the reservoir chamber 56. This means that the control bushing 52 must not be allowed to contact the stopper 70 receiving the check valve 55, and for this reason the maximum pumping quantity of the pump must always be greater than the maximum injection quantity. This can be accomplished by suitable dimensioning of the piston stroke or the piston surface area. To reduce pulsation, it is possible to replace the eccentric 14 with a cam contour having a higher number of cam pitches.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A reservoir fuel injection system, comprising a fuel pump, a drive shaft that drives said fuel pump, said fuel pump delivering fuel under pressure to a reservoir in a fuel supply pressure line from a supply, a fuel distributor shaft (9), a line carrying fuel under pressure from the reservoir via a valve assembly and said fuel distributor shaft to at least one injection nozzle, an adjustable throttle being provided in said supply line for varying the quantity of fuel supplied to the reservoir, said throttle (19, 26, 52), upon attainment of a maximum pressure in said reservoir (3, 56), enabling aspiration of a minimum quantity of fuel in an intake line (15) of said pump and the reservoir (3, 56), upon attainment of a maximum pressure therein, opening an outflow cross section (22, 47, 63) to a fuel return line.

2. A reservoir fuel injection system as defined by claim 1, in which said throttle comprises a piston (19, 26) displaceable counter to a force of a piston spring to penetrate the line cross section (15, 25) to be throttled, said piston having a circumferential groove (20, 30) plunging into the line cross section to be throttle, and being acted upon counter to a force of said piston spring (18, 27, 32, 49) by a pressure in the reservoir (3).

3. A reservoir fuel injection system as defined by claim 1, in which said throttle (26) is disposed in a branch line (25) connecting said intake line (1 5) to said pressure line (4).

4. A reservoir fuel injection system as defined by claim 1, in which said spring (27) has a degressive spring characteristic curve which acts upon said piston of said throttle (26).

5. A reservoir fuel injection system as defined by claim 2, in which said spring (27) has a degressive spring characteristic curve which acts upon said piston of said throttle (26).

6. A reservoir fuel injection system as defined by claim 3, in which said spring (27) has a degressive spring characteristic curve which acts upon said piston of said throttle (26).

7. A reservoir fuel injection system as defined by claim 1, in which said reservoir has at least one control means that can be overtaken by a spring loaded reservoir piston (17), by way of which groove, upon attainment of an intended fill volume of reservoir, pressure fluid is carried to an end face (29), remote from the piston spring (32), of said piston (19) of the throttle (26).

8. A reservoir fuel injection system as defined by claim 2, in which said reservoir has at least one control means that can be overtaken by a spring loaded reservoir piston (17), by way of which groove, upon attainment of an intended fill volume of the reservoir, pressure fluid is carried to an end face (29), remote from the piston spring (32), of said piston (19) of the throttle (26).

9. A reservoir fuel injection system as defined by claim 7, in which said spring-loaded reservoir piston (17) has a relief bore (36) overtaking the control means.

10. A reservoir fuel injection system as defined by claim 8, in which said spring-loaded reservoir piston (17) has a relief bore (36) overtaking the control means.

11. A reservoir fuel injection system as defined by claim 6, in which said relief bore (36) of the reservoir piston, upon opening of a first control bore (34) by way of which pressure fluid is carried from the reservoir (3) to the throttle (26), is flush with a second control bore (38), which second control bore (38) communicates via a line (39) with a spring chamber (40) of the piston (19) of the throttle (26), and that the intake line (15) is connected to the spring chamber (40) via an outwardly one-way closing check valve (43).

12. A reservoir fuel injection system as defined by claim 10, in which said relief bore (36) of the reservoir piston, upon opening of a first control bore (34) by way of which pressure fluid is carried from the reservoir (3) to the throttle (26), is flush with a second control bore (38), which second control bore (38) communicates via a line (39) with a spring chamber (40) of the piston (19) of the throttle (26), and that the intake line (15) is connected to the spring chamber (40) via an outwardly one-way closing check valve (43).

13. A reservoir fuel injection system as defined by claim 11, in which said reservoir includes a pressure chamber (44) which can be relieved via an overpressure value (47), integrated with the reservoir on piston (17), into the reservoir spring chamber (68) of the reservoir piston (17) and via the second control bore (38) into the piston spring chamber (40) of the piston of the throttle (26).

14. A reservoir fuel injection system as defined by claim 12, in which said reservoir includes a pressure chamber (44) which can be relieved via an overpressure valve (47), integrated with the reservoir piston (17), into the reservoir spring chamber (68) of the reservoir piston (17) and via the second control bore (38) into the piston spring chamber (40) of the piston of the throttle (26).

15. A reservoir fuel injection system as defined by claim 2, in which the piston of the throttle (19) is displaceable between stops, in particular stop sleeves (50), counter to the force of a piston spring (49).

16. A reservoir fuel injection system as defined by claim 1, in which upon incorporation of a throttle into a branch line (25) connecting the pressure line (4) to the intake line (15), the pressure reservoir (3) communicates via a check valve (31) closing toward the pump (1) with the pressure line (4) downstream of the connection point of the branch line (25).

17. A reservoir fuel injection system as defined by claim 2, in which upon incorporation of a throttle into a branch line (25) connecting the pressure line (4) to the intake line (15), the pressure reservoir (3) communicates via a check valve (31) closing toward the pump (1) with the pressure line (4) downstream of the connection point of the branch line (25).

18. A reservoir fuel injection system as defined by claim 1, in which said throttle is embodied as a control bushing (52) surrounding a pump piston (12), a control edge (51) of said control bushing, communicates with said intake line (15), and is displaceable axially with said control bushing (52) in order to limit an effective pump stroke, and that said control bushing (52) is connected to a movable part of said pressure reservoir.

19. A reservoir fuel injection system as defined by claim 18, in which said control bushing (52), includes a bottom (72) and a stopper (70) within said bushing, defines a reservoir chamber (56) of a pressure reservoir and is acted upon by a restoring spring (62).

20. A reservoir fuel injection system as defined by claim 18, in which a valve (63, 60) is controlled as a function of a stroke of the control bushing (52) and controllably relieves the reservoir chamber (56).

21. A reservoir fuel injection system as defined by claim 19, in which a valve (63, 60) is controlled as a function of a stroke of the control bushing (52) and controllably relieves the reservoir chamber (56).

* * * * *